United States Patent [19]

Haslam

[11] 4,153,092

[45] May 8, 1979

[54] CONVERTIBLE HANDBAG

[76] Inventor: Beverly J. Haslam, 1392 Merritt, El Cajon, Calif. 92021

[21] Appl. No.: 902,439

[22] Filed: May 3, 1978

[51] Int. Cl.[2] ..... A45C 9/00

[52] U.S. Cl. ..... 150/33; 224/126

[58] Field of Search ..... 150/1.6, 1.7, 33; 224/9, 26 R, 46 R, 44

[56] References Cited

U.S. PATENT DOCUMENTS

| | | | |
|---|---|---|---|
| 1,370,636 | 3/1921 | Dwyer | 224/46 R UX |
| 2,133,717 | 10/1938 | Robes | 224/9 X |
| 3,346,155 | 10/1967 | Oechsle | 224/9 |
| 3,802,613 | 4/1974 | Droeger | 224/9 |
| 3,912,141 | 10/1975 | Appel | 150/33 |

FOREIGN PATENT DOCUMENTS

| | | | |
|---|---|---|---|
| 439856 | 1/1927 | Fed. Rep. of Germany | 150/1.7 |

*Primary Examiner*—Donald F. Norton

*Attorney, Agent, or Firm*—Brown & Martin

[57] ABSTRACT

A handbag of the usual general construction is provided with a novel strap arrangement, including a pair of carrying straps having button loops at the outer ends thereof and cooperating with buttons on each of the respective straps for unitary type strap hand carrying configuration for either handbag or shoulder bag mode, and for cooperating with buttons secured to the back of the bag for providing a back-pack mode of carrying, and also for cooperating with the straps from another similar bag for providing a saddle bag mode.

7 Claims, 6 Drawing Figures

CONVERTIBLE HANDBAG

BACKGROUND OF THE INVENTION

The present invention relates to bags and pertains particularly to a bag convertible to many modes of carrying, such as from handbag to backpack and saddle bag.

Ladies handbags that can be transformed to shoulder bags are known and are popular because of this versatility. The casual lifestyles of many outdoor people dictate that other types of bags are necessary for carrying of personal items. Hikers and bike riders, for example, frequently carry backpacks in which personal items are carried. Many bikers also carry saddle bags which hang across a rack or the frame of the bicycle. It is inconvenient to frequently transfer personal items from one bag to another.

For active outdoor type people, it is desirable that a bag be available which is convertible to many modes consistent with the style of living. Accordingly, it is desirable that a bag be available which is convertible to and from handbag or shoulder bag, back-pack, and saddle bag configurations or modes.

SUMMARY AND OBJECTS OF THE INVENTION

Accordingly, it is the primary object of the present invention to overcome the above problems of the prior art.

Another object of the present invention is to provide a bag that is convertible to multiple modes of use.

A still further object of the present invention is to provide a bag having a carrying strap arrangement that cooperates to convert the bag to and from hand bag and shoulder bag, back-pack, and saddle bag.

In accordance with the primary aspect of the present invention, a bag is provided with a pair of carrying straps which cooperate with fastening means to define a shoulder strap or a hand carrying strap and to convert to shoulder straps for back-pack mode and to cooperate with a like bag for providing a saddle bag mode.

BRIEF DESCRIPTION OF THE DRAWING

The above and other objects and advantages of the present invention will become apparent from the following description when read in conjunction with the drawings, wherein.

DETAILED DESCRIPTION OF A PREFERRED EMBODIMENT

Figure 3:
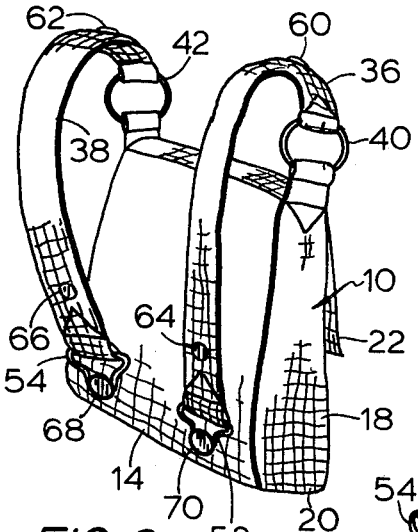
FIG. 3 is a rear perspective view of the bag showing the shoulder or back-pack mode.
Figure 2:
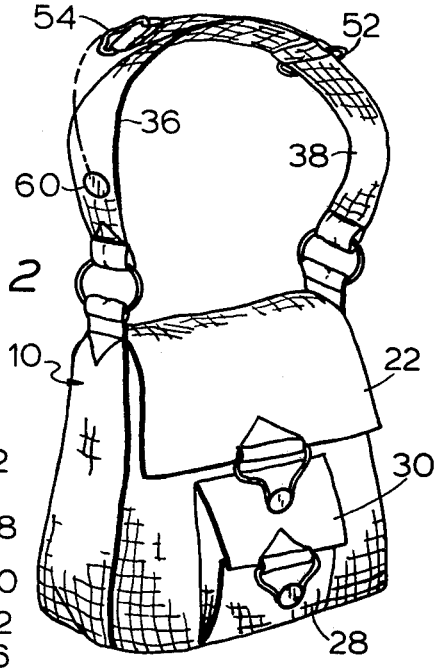
FIG. 2 is a view like FIG. 1, showing the straps partially interconnected for the handbag mode.
Figure 1:
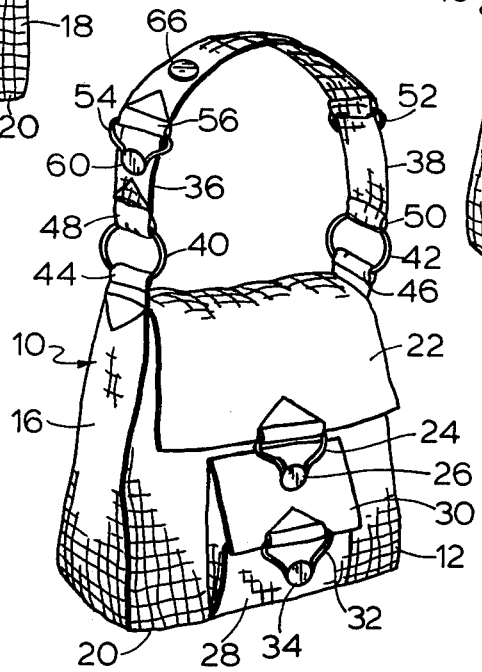
FIG. 1 is a front perspective view of a bag in accordance with the present invention, showing the strap in the handbag mode.

Turning now to the drawings, and particularly to FIGS. 1 through 3, there is illustrated a bag designated generally by the numeral 10 having a carrying strap arrangement for connecting into multiple modes in accordance with the invention. The bag comprises front and rear panels 12 and 14 interconnected by side panels 16 and 18 and bottom panel 20 for defining an upwardly opening compartment. A flap 22 which may be formed as an extension of the back, or as a separate flap, extends over the open top of the bag and includes fastening means in the form of a button loop 24 engaging a button 26 for retaining the flap in the closed position. An auxiliary additional pouch 28 is formed or attached to the front of the bag and includes a flap 30 similarly held in the closed position by a button loop 32 engaging a button 34. Other suitable fastening means may be provided if desired.

The above described bag is provided with carrying straps in a form and arrangement which can be converted easily to and from various modes of carrying. The bag may be constructed of any suitable material, such as leather, plastic, or any fabric material. The bag is provided with a pair of separate carrying straps 36 and 38, each having an inner end connected in a suitable manner, such as by means of a loop or a ring 40 and 42 respectively. These loops or rings are preferably of a metal and of a large enough loop to receive the width of the straps themselves. The rings 40 and 42 are each connected to the bag near the top preferably at opposite sides thereof by means of suitable straps or the like 44 and 46 which extend through the rings 40 and 42 looped back and secured, such as by sewing in a fashion as shown. The straps 36 and 38 are similarly connected to the rings 40 and 42 by a strap or loop portion thereof 48 and 50 which similarly extends through and is secured in a loop configuration around the ring such as by sewing.

The outer end of each of the straps is provided with a button loop, substantially in the configuration as shown, having a semi-circular portion for engaging a button and a somewhat rectangular portion for engaging a loop in the end of the strap. These loops 52 and 54 are connected as by means of looped tabs 56 and 58 formed by the outer ends of the respective straps 36 and 38 being extended through the generally rectangular portion of loops 52 and 54 and secured, such as by sewing, to the body of the strap.

Second fastening means in the form of plurality of pairs of buttons provide means for use in conjunction with the straps for converting the bag to the various modes to be described. A first pair of buttons 60 and 62 are placed on the straps 36 and 38 in a convenient position to provide either for a handbag mode of carrying the bag as shown in FIG. 1, or a shoulder bag mode. A single set of the buttons may be provided for a single mode, such as handbag or shoulder bag as desired. This of course, would also depend on the size of the bag and the length of the respective straps. Additional buttons may be placed on the straps, such as at 64 and 66, for providing the shoulder bag mode if the bag also includes buttons 60 and 62 placed close to the rings 40 and 42, as shown in FIG. 1. The additional set of buttons permits a longer strap arrangement than that as shown in FIG. 1, in order to provide a shoulder bag mode or configuration. An additional set of buttons 68 and 70 as best seen in FIG. 3 are providing for a back-pack mode or configuration of the bag as illustrated in FIG. 3. These additional buttons which are attached to the back panel 14 of the bag preferably near or adjacent the bottom thereof provide also for an additional configuration to be described with regards to FIGS. 4 and 5.

Returning for a moment to the configuration as shown in FIGS. 1 and 2, the straps are such that the loops 54 and 52 have a generally rectangular portion as previously described, for receiving the corresponding other strap as shown in FIG. 2 when the straps are interlocked and overlapped for the hand bag or shoulder bag mode or configuration. As shown in FIG. 2, the strap 38 extends through the loop 52 and over the top of strap 36 hooking or looping about button 60. The loop 52 receives the strap 38 and at the same time hooks over button 62 on the strap 38.

Figure 4:
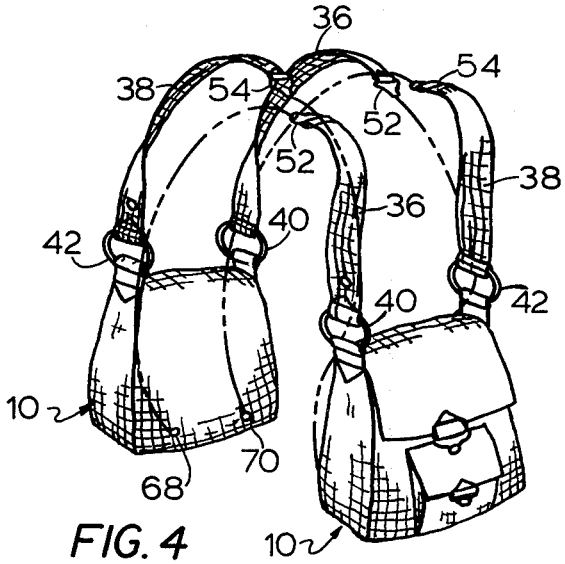
FIG. 4 is a perspective view showing a second identical bag in a process of interconnection for a saddle bag mode.
Figure 5:
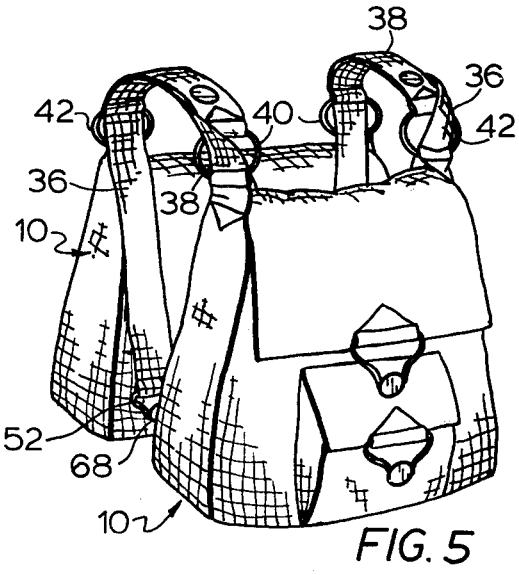
FIG. 5 is a perspective view of a pair of bags interconnected into a saddle bag mode.

This strap configuration, as shown in FIGS. 1 through 3, also provides a cooperative arrangement with an identical bag, or at least a bag of identical strap configuration for providing a saddle bag mode or configuration as shown in FIGS. 4 and 5. As shown in FIG. 4, a pair of preferably identical bags 10 having identical strap configurations are placed back to back. The straps are then arranged with straps 36 and 38 of one bag, such as the one on the left, overlapped above the straps 36 and 38 of the bag on the right and following the path lines extend through the loops 40 and 42 of the straps and extend downward with the loops or button loops hooking the buttons on the back of the bag. Similarly, the straps 36 and 38 of the bag 10 on the right extend through the rings 40 and 42 of the bag on the left, extending downward and engaging the buttons 68 and 70 on the back of the bag. This then provides a configuration such as shown in FIG. 5.

Figure 6:
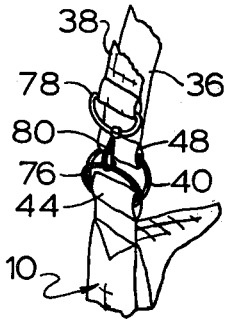
FIG. 6 is a perspective view of alternate strap connectors.

An alternate connection arrangement is illustrated in FIG. 6. In this arrangement, D rings 78 replace the button loops 52, 54 on straps 36 and 38, and D rings 76 in loops 44 and 46 replace the buttons 60 and 62. The D rings are preferably made of a metal such as brass or stainless steel. A swivel clip 80 (spring and hook type) then mounted on ring 78 clips to ring 76. The remaining buttons and loops can also be replaced with the clip and D ring arrangement. This could provide a more rugged construction when desired.

While I have illustrated and described my invention by means of a single embodiment, it is to be understood that numerous changes and modifications may be made therein without departing from the spirit and scope of the invention as defined in the appended claims.

Having described my invention, I now claim:

1. A bag having front, back and side walls connected to a bottom and defining a compartment having an open top, in combination with carrying apparatus enabling said bag to be converted to multiple carrying modes, said carrying apparatus comprising:

first and second straps having inner and outer ends, each strap connected at the inner end to said bag adjacent the top and a side thereof, and including a button loop on the outer end thereof, a first pair of buttons, one attached to each of said pair of straps for cooperative engagement with a button loop for defining a unitary carrying strap and a handbag mode, a second pair of buttons attached to the back wall of said bag for separately cooperating with individual ones of said button loops for defining a back-pack mode of carrying said bag and for engagement with button loops on individual straps from a second like bag for defining with said second bag a saddle bag mode.

2. The bag of claim 1, wherein said first pair of said buttons are mounted on the outer surface of said straps and located at a selected position between the ends thereof.

3. The bag of claim 2, including loop means connecting each of said straps to said bag, the loop of each strap adapted to receive a portion of the other strap of said other bag passed therethrough for defining said saddle bag mode.

4. The bag of claim 3, wherein said loop is a metal ring.

5. The bag of claim 2, wherein said button loop comprises a semi-circular loop portion for looping about a button and a generally rectangular loop portion for connecting to the end of one of said straps and for receiving a portion of the other strap extending therethrough when in said hand bag carrying mode.

6. The bag of claim 1, wherein said second pair of said buttons are secured to said back panel near the bottom thereof.

7. A bag having front, back and side walls connected to a bottom defining a compartment having an open top in combination with carrying apparatus enabling said bag to be converted to multiple carrying modes, said carrying apparatus comprising:

first and second straps having inner and outer ends, each strap connected at the inner end to said bag adjacent the top and a side thereof, and including a metal ring and clip on the outer end thereof, a first pair of rings, one attached to each of said pair of straps for cooperative engagement with a clip for defining a unitary carrying strap and a handbag mode, a second pair of rings attached to the back wall of said bag for separately cooperating with individual ones of said clips for defining a back-pack mode of carrying said bag and for engagement with clips on individual straps from a second like bag for defining with said second bag a saddle bag mode.

* * * * *